US006026856A

United States Patent [19]

Miyazoe et al.

[11] Patent Number: 6,026,856

[45] Date of Patent: Feb. 22, 2000

[54] THREE-PORT SOLENOID VALVE USING A VALVE BODY FOR A FIVE-PORT SOLENOID VALVE

[75] Inventors: Shinji Miyazoe; Bunya Hayashi; Makoto Ishikawa, all of Ibaraki, Japan

[73] Assignee: SMC Corporation, Tokyo, Japan

[21] Appl. No.: 09/124,891

[22] Filed: Jul. 30, 1998

[30] Foreign Application Priority Data

Aug. 21, 1997 [JP] Japan ..... 9-240405

[51] Int. Cl.[7] ..... F15B 13/043

[52] U.S. Cl. ..... 137/596.16; 137/596.18

[58] Field of Search ..... 137/596.16, 596.18

[56] References Cited

U.S. PATENT DOCUMENTS

| | | | |
|---|---|---|---|
| 3,701,599 | 10/1972 | Stewart . | |
| 3,870,073 | 3/1975 | Ruchser et al. . | |
| 4,616,674 | 10/1986 | Bardoll | 137/596.16 X |
| 4,924,902 | 5/1990 | Lewis et al. | 137/596.16 X |
| 5,606,993 | 3/1997 | Stoll | 137/596.16 X |

FOREIGN PATENT DOCUMENTS

| | | | |
|---|---|---|---|
| 0 655 575 | 5/1995 | European Pat. Off. . | |
| 1 284 231 | 2/1969 | Germany . | |
| 38 17 120 | 11/1989 | Germany . | |
| 55-82865 | 6/1980 | Japan | 137/596.16 |

*Primary Examiner*—Gerald A. Michalsky

*Attorney, Agent, or Firm*—Oblon, Spivak, McClelland, Maier & Neustadt, P.C.

[57] ABSTRACT

Inexpensive three-port solenoid valves that can be connected to five-port solenoid transfer valves and allow the axial movement of valve discs to be stably guided, are provided. Two valve discs constituting a three-port valve are inserted into a five-port valve body having a supply channel opened at the center of a valve hole; output channels are open on the respective sides of the supply channel; and ejection channels are open on the respective sides of the output channels. A pilot-valve section is used to drive the valve discs. The valve discs use the fluid pressure in the supply channel as returning force for the valve bodies, and each have seal members for switching the output channels between the supply channel and the ejection channels respectively, for communication; and guide sections and for guiding the axial movement of the valve discs, wherein a fluid groove for a fluid flowing through the channel is provided between the plurality of axial guide sections.

3 Claims, 4 Drawing Sheets

THREE-PORT SOLENOID VALVE USING A VALVE BODY FOR A FIVE-PORT SOLENOID VALVE

FIELD OF THE INVENTION

The present invention relates to a three-port solenoid valve suitable for use with a large number of connected five-port solenoid valves.

PRIOR ART

Five-port solenoid transfer valves are commonly connected together on rails or manifold bases to control the operation of various fluid-pressure-driven apparatuses, and in some cases these valves must include three-port solenoid valves. Three-port valves, however, differ from five-port valves in form, and various problems are involved in connection with five-port valves.

These problems can be solved by directly using a valve body for a five-port solenoid valve and integrating two three-port valves into the valve body to constitute a solenoid valve. Furthermore, many common parts can be used to provide inexpensive products, and this solenoid valve can also be used as a four-position valve.

Essentially, however, a single valve disc is inserted into a valve hole in the valve body of the five-port valve while being guided at both ends. Thus, when two divided valve discs of three-port valves are inserted into the valve hole, the supply-channel side of the valve disc is not guided and the position of each valve disc becomes unstable. Consequently, seal members may not stably provide a seal function, and when the seal members more onto lands they may slip out from fitting grooves or be damaged when caught between the land and the valve disc.

DISCLOSURE OF THE INVENTION

It is a technical object of this invention to provide a solenoid valve in which a valve body for a five-port solenoid valve is directly used and in which two three-port valves are integrated into the valve body to enable the axial movement of the valve disc to be guided stably.

To achieve this object, this invention provides a solenoid valve comprising a main valve having a five-port valve body in which a valve hole is opened and which has a supply channel opened at the center of the valve hole, two output channels opened on the respective sides of the supply channel, and two ejection channels opened on the respective sides of the output channels, the main valve also having a valve disc slidably disposed in the valve hole, and first and second pistons on the respective axial sides of the valve hole, the main valve operating the valve disc using the effect of the pressure of a pilot fluid on the pistons, the solenoid valve also comprising a pilot-valve section consisting of first and second pilot valves including first and second solenoid mechanisms that operate to individually apply the pressure of a pilot fluid to the first and second pistons, characterized in that the valve disc that is inserted into the valve hole in the valve body is composed of two valve discs using the acting force of the fluid pressure in the supply channel as a returning force for the valve discs on the respective sides of the supply channel, in that these valves each have a seal section for switching an output channel between the supply channel and the ejection channels, in that a guide section for guiding the axial movement of the valve disc is provided at that end of each valve disc abutted by a piston, and in that a plurality of axial guide sections located on lands disposed on the respective sides of the supply channel even when the seal section is in the communication section are provided around the valve discs so that a channel groove for a fluid flowing through the channel is provided between the guide sections, the seal section moving to switch between a sealing position at which the seal section moves onto the lands, and a communication position at which the seal section leaves the lands.

According to this solenoid valve, a plurality of axial guide sections located on lands disposed on the respective sides of the supply channel even when the seal section is in the communication section are provided on the side that moves onto the lands so that a channel groove for a fluid flowing through the supply channel is provided between the guide sections, with the seal section switching the movement of the fluid between the sealing positions at both ends of the supply channel at which the seal section moves onto the lands, and a communication position at which the seal section leaves the lands for the supply-channel side, or a plurality of axial guide sections located on lands disposed on the respective sides of the supply channel even when the seal section is in the communication section are provided on the side that moves onto the lands so that a channel groove for a fluid flowing through the output channels is provided between the guide sections, with the seal section switching the movement of the fluid between the sealing positions located at both ends of the supply channel at which the seal section moves onto the lands, and a communication position at which the seal section leaves the lands for the supply-channel side.

The solenoid valve of this configuration can be directly used with a valve body for a five-port solenoid valve and can share varios parts of this valve body, so inexpensive three-port solenoid valves can be provided that can be used in combination with a large number of five-port solenoid transfer valves. In addition, although the position of the valve disc that is inserted into the valve hole becomes unstable when it is simply divided in two, the provision of the guide sections enables the seal section to appropriately move onto the lands while maintaining the required flow.

DESCRIPTION OF THE PREFERRED EMBODIMENTS

Figure 1:
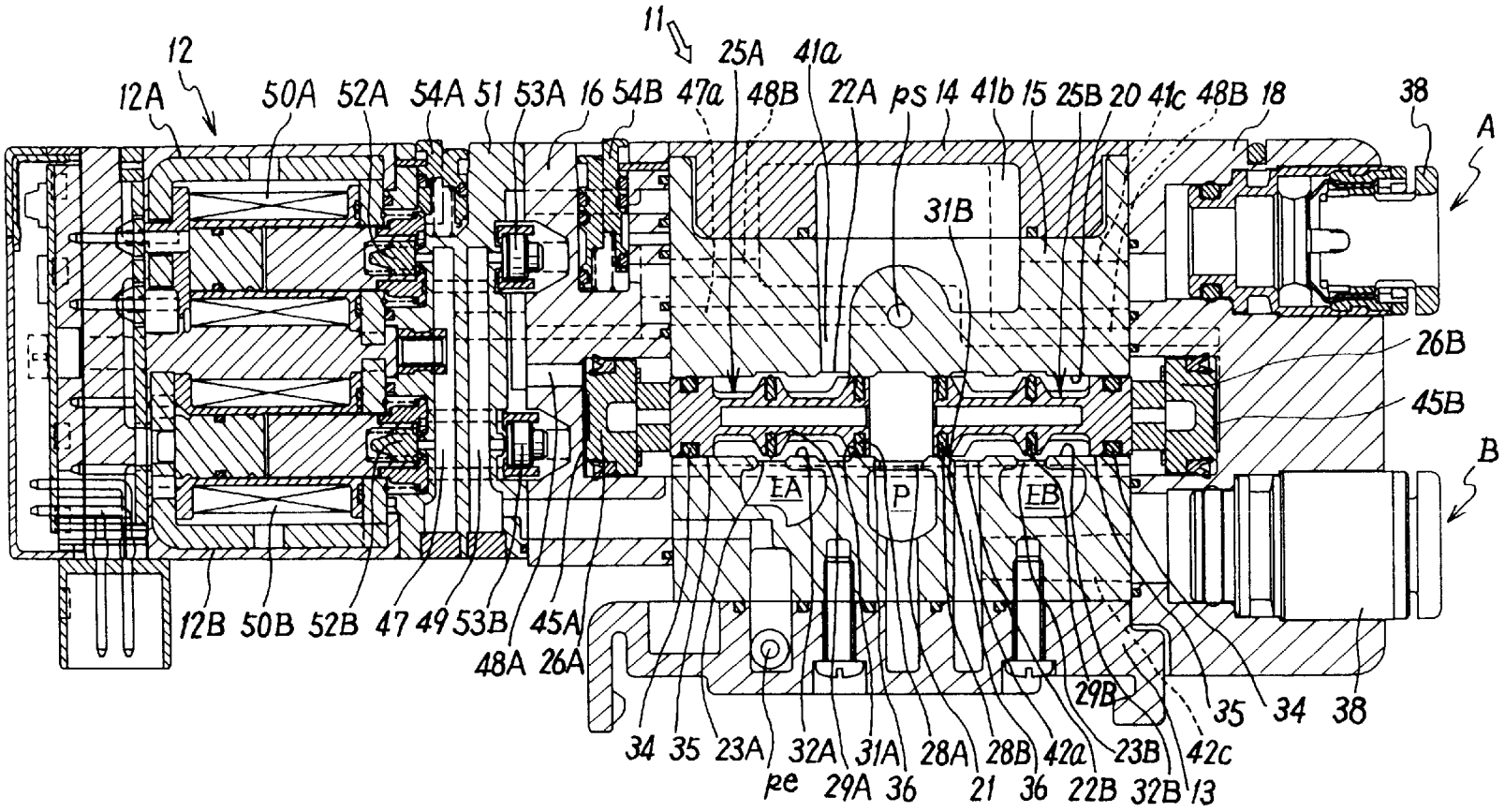
FIG. 1 is a sectional view showing the structure of a first embodiment of a three-port solenoid valve according to this invention with no power supplied.
Figure 2:
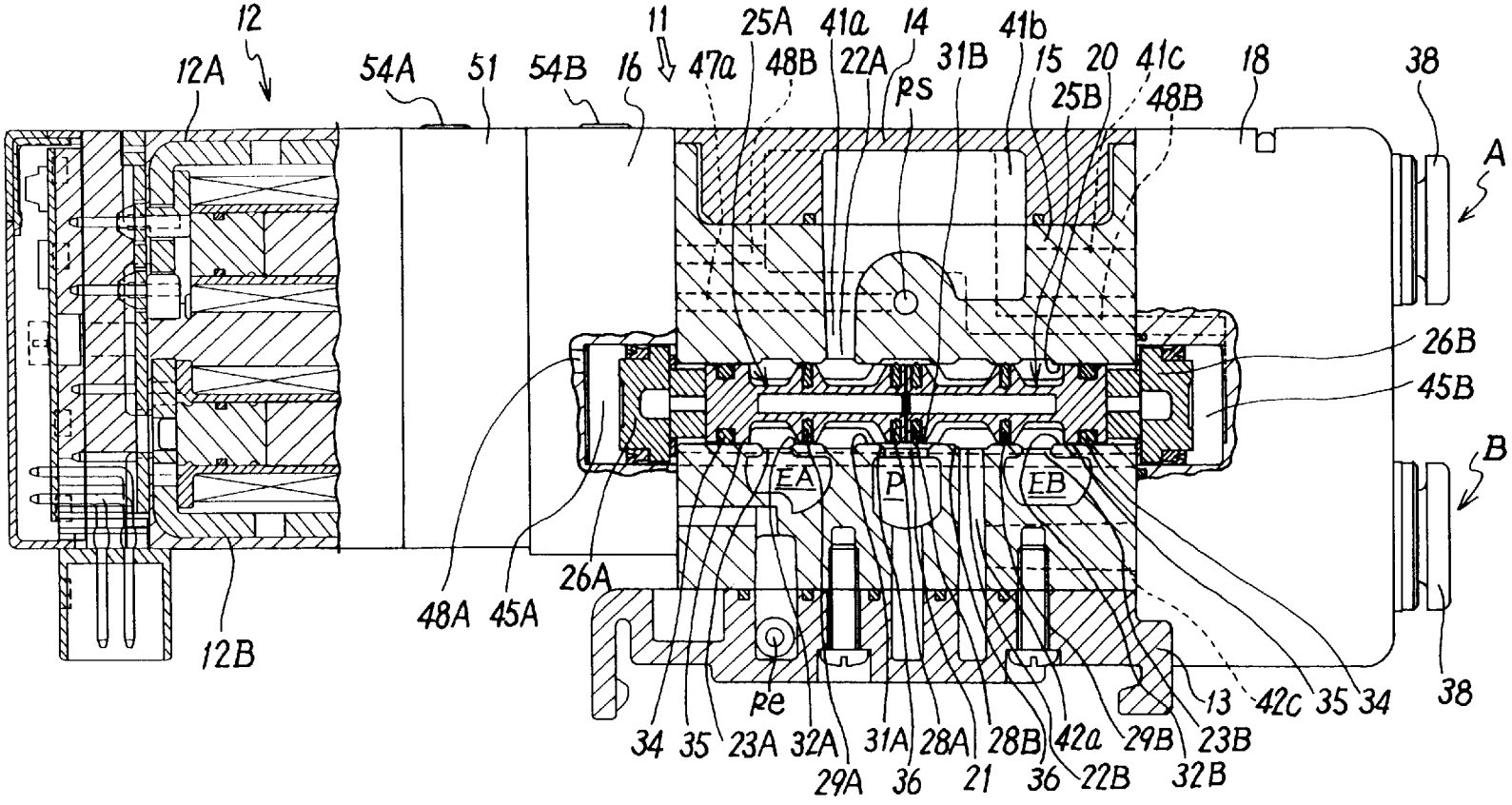
FIG. 2 is a schematic sectional view of the solenoid valve according to the first embodiment with power supplied.

FIGS. 1 and 2 show a first embodiment of a solenoid valve according to this invention. This solenoid valve is formed by directly using a valve body for a five-port solenoid valve and integrating two three-port valve discs, which are described below, into a valve hole inside the valve body. FIG. 1 shows the two three-port normally closed valves with no power supplied, and FIG. 2 shows them with power supplied. This solenoid valve comprises a main valve 11 into which the valve discs are integrated; and a pilot-valve section 12 having two pilot solenoid valves 12A and 12B. The bottom cover 13 of the main valve 11 can be used to connect a plurality of such solenoid valves together with a large number of five-port solenoid valves on DIN rails (not shown).

The main valve 11 comprises a valve body 15 on which the bottom cover 13 and top cover 14 are mounted; a piston box 16 mounted on one of the end surfaces of the valve body 15; and an end plate 18 mounted on the other end surface of the valve body 15. Since the valve body 15 is used for five-port solenoid valves, it includes a supply through-hole P, first and second ejection through-holes EA and EB, and a pilot supply through-hole ps for compressed air, all of which penetrate the valve body 15 in the direction in which a plurality of valve bodies 15 are connected together in such a manner that a plurality of respective through-holes are mutually in communication, and also includes a valve hole 20 that penetrates both end surfaces on which the piston box 16 and end plate 18 are mounted. A central supply channel 21 in communication with the supply through-hole P, two output channels 22A and 22B located on the respective sides of the supply channel 21, and two ejection channels 23A and 23B located on the respective sides of the output channels 22A and 22B and communicating with the first and second ejection through-holes EA and EB are all opened into the valve hole 20.

Although a plurality of main valves 11 are connected together on DIN rails using the bottom cover 13, the supply through-hole P, first and second ejection through-holes EA and EB, and pilot supply through-hole ps may be provided in a manifold base, on which a plurality of valve bodies 15 each having a valve hole 20 may be connected together.

The valve disc that is slidably inserted into the valve hole 20 in the valve body 15 is composed of two valve discs 25A and 25B use the acting force of the fluid pressure in the supply channel as a returning force on the respective sides of the supply channel 21. In addition, first and second pistons 26A and 26B that are separate from the valve discs 25A and 25B, respectively, press the valve discs 25A and 25B when subjected to the pressure of a pilot fluid, and have a larger diameter than the valve discs 25A and 25B these pistons are disposed on the respective axial sides of the valve hole 20.

The valve discs 25A and 25B have seal members 28A and 28B, respectively, that open and close the paths between the supply channel 21 and the output channels 22A and 22B, respectively, and have seal members 29A and 29B that open and close the paths between the output channels 22A and 22B and the ejection channels 23A and 23B, respectively. The seal members 28A and 28B repeatedly move between an intermediate position (FIG. 2) at which they are located on the supply channel 21 and a sealing position (FIG. 1) between the supply channel 21 and the output channels 22A and 22B at which they move onto lands 31A and 31B, respectively, in response to the operation of the valve discs, while the seal members 29A and 29B repeatedly move between an intermediate position (FIG. 1) at which they are located on the ejection channels 23A and 23B, respectively, and a sealing position (FIG. 2) between the ejection channels 23A and 23B and the output channels 22A and 22B at which they move onto lands 32A and 32B, respectively. In addition, when one of the seal sections in one of the valve discs is in the intermediate position, the other seal section is in the sealing position, whereas when one of the seal sections is in the sealing position, the other seal section is in the intermediate position.

The valve discs 25A and 25B are separately inserted into the valve hole 20 into which, in the case of a five-port valve, a single valve disc is inserted while being guided at both ends. Thus, unless the guide for the valve discs on the supply-channel side is taken into account, the position of the valve disc is unstable and the axes of the valve discs 25A and 25B are tilted relative to the axis of the valve hole 20. Consequently, when the seal members move onto the lands, they may slip out from fitting grooves or be caught between the land and the valve disc.

Figure 3:
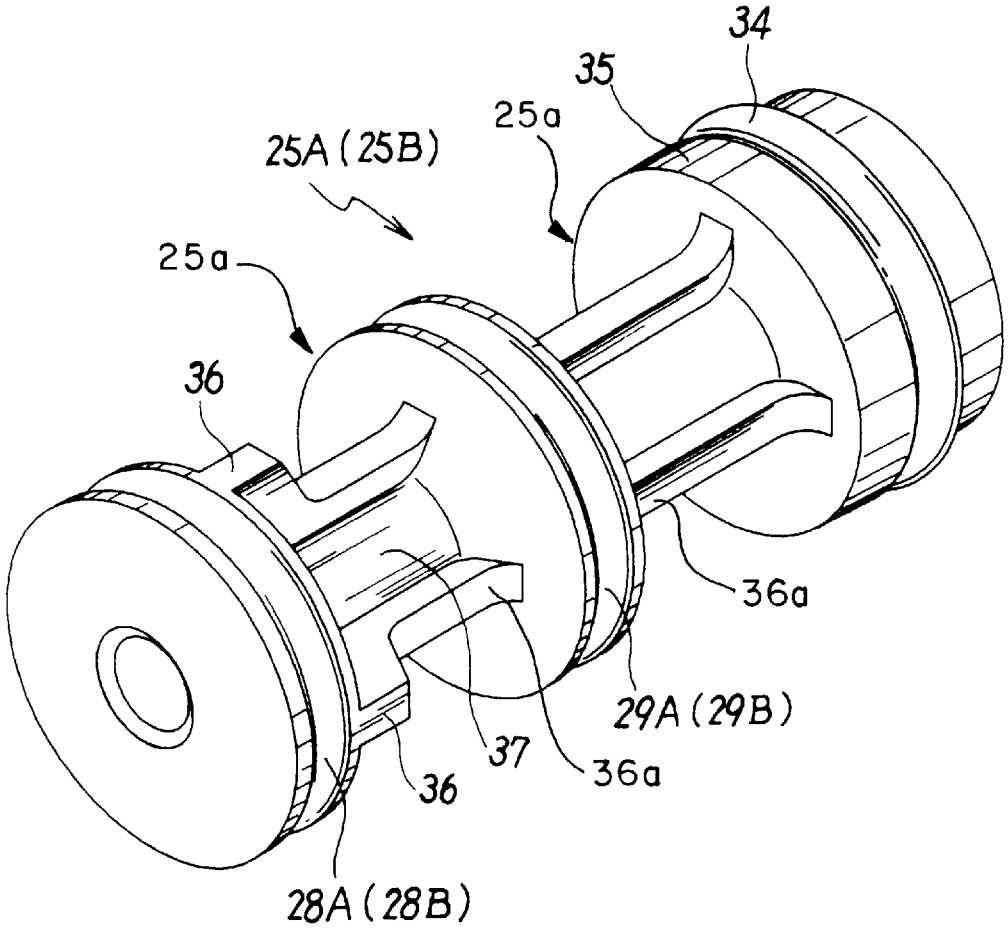
FIG. 3 is a enlarged perspective view showing the structure of a valve disc used in the first embodiment.

Thus, a guide section 35 is provided at the piston-side end of each of the valve discs 25A and 25B and adjacent to a seal member (an O ring) 34, and around the valve discs on the piston side of the seal members 28A and 28B that open and close the supply channel 21 that is, switch between a communication position (FIG. 2) on one side of the supply channel 21 at which the seal member is dislocated from the land 32A or 32B and a sealing position (FIG. 1) at which the sealing member moves onto the land, a plurality of axial guide sections 36 that are located on the lands 32A and 32B to guide the seal members 28A and 28B, respectively, onto the lands even when the seal members are dislocated from the lands are provided in such a way that a channel groove 37 for a fluid flowing through the supply channel 21 is provided between the guide sections 36, as shown in FIG. 3.

Although these guide sections 35 and 36 are provided to stabilize the positions of the valve discs 25A and 25B, only a plurality of guide sections may be provided in the same form as the guide sections 36, wherein the guide sections allow the seal members 29A and 29B, which move onto the lands 32A and 32B, respectively, between the ejection channels 23A and 23B and the output channels 22A and 22B, to smoothly move onto the lands, and that are located on the lands 32A and 32B to guide the seal members 29A and 29B onto the lands even when the seal members are dislocated from the lands, as in the embodiment described below.

The valve discs 25A and 25B of such a structure have a complex shape, so they may be particularly effectively manufactured by means of molding with a lubricative synthetic resin.

First and second output ports A and B are opened in the outer side of the end plate 18 mounted on the valve body 15 in such a way that the ports are parallely located in parallel in the vertical direction, and the first and second output channels 22A and 22B opened into the valve hole 20 are in communication with the output ports A and B through a passage formed in the valve body 15. In the figure, reference numeral 38 designates a one-touch joint installed in each of the output ports A and B.

The first output channel 22A is communicated with the output port A by opening the first output channel 22A through a guide channel 41*a* into a channel 41*b* formed by mounting the top cover 14 in a recessed portion of the top surface of the valve body 15 and opening the channel 41*b* into the first output port A through a through-hole 41*c* opened in the valve body 15. On the other hand, the opposite second output channel 22B is opened from the bottom surface of the valve body 15 through a guide channel 42*a*, which is in communication with the second output port B via a through-hole 42*c* opened in the valve 15.

The first piston 26A is slidably inserted into a first piston chamber 45A in an airtight manner, with the chamber 45A being formed in the piston box 16, and the second piston 26B is slidably inserted into a second piston chamber 45B in an airtight manner, with the chamber 45B being formed in the end plate 18. When a pilot fluid is supplied to the first piston chamber 45A from the first output channel 48A, the force of the pilot-fluid pressure acting on the first piston 26A of a larger diameter than the valve disc 25A exceeds the force of a pressurized fluid from the supply through-hole P acting on the opposite end surface of the valve disc 25A, so the valve disc 25A moves rightward from the switching position shown in FIG. 1 to the switching position shown in FIG. 2. Thus, the seal member 28A allows the supply channel 21 to communicate with the first output channel 22A while the seal member 29A provides a seal between the first output channel 22A and the first ejection channel 23A, thereby causing a pressurized fluid to be output from the first output port A. When the pilot fluid in the first piston chamber 45A is ejected, the valve disc 25A is returned by the acting force of the pressurized fluid through the supply through-hole P.

In addition, when a pilot fluid is supplied to the second piston chamber 45B through the second pilot output passage 48B, the second piston 26B and valve disc 25B similarly move leftward from the switching position shown in FIG. 1 to the switching position shown in FIG. 2. Thus, the seal member 28B allows the supply channel 21 to communicate with the second output channel 22B while the seal member 29B provides a seal between the second output channel 22B and the second ejection channel 23B, thereby causing a pressurized fluid to be output from the second output port B.

The first and second pilot solenoid valves 12A and 12B installed on the pilot-valve section 12 in parallel to drive the valve discs 25A and 25B are configured as well-known normally closed three-port solenoid valves; these solenoid valves include a pilot inlet passage 47, a pilot output passage 48A and 48B, and a pilot exhaust passage 49, and energize and de-energize solenoids 50A and 50B to switch the pilot output passages 48A and 48B between the pilot inlet passage 47 and the pilot exhaust passage 49 for communication.

The pilot inlet passage 47 for these pilot solenoid valves 12A and 12B is in communication with the pilot supply passage ps through a passage formed in the pilot-valve main body 51 and the piston box 16 and valve body 15. A pilot output passage 48A for the solenoid valve 12A is in communication with the first piston chamber 45A, a pilot output passage 48B for the solenoid valve 12B is in communication with the second piston chamber 45B, and a pilot exhaust passage 49 for the solenoid valve 12A and 12B is in communication with a pilot ejection passage pe.

The pilot solenoid valves 12A and 12B include inlet valve discs 52A and 52B and exhaust valve discs 53A and 53B located on the respective sides of the pilot-valve main body 51 to operate cooperatively. When the solenoid 50A or 50B is energized, the inlet valve disc 52A or 52B is opened to allow the pilot inlet passage 47 to individually communicate with the first or second pilot output passage 48A or 48B, while the exhaust valve disc 53A or 53B is closed to shut off the passage leading from the pilot output passage 48A or 48B to the pilot exhaust passage 49.

Consequently, a pilot fluid is supplied to the piston chamber 45A or 45B. In addition, when the solenoid 50A or 50B is de-energized, the inlet valve disc 52A or 52B is closed and the exhaust valve disc 53A or 53B is opened to open the passage leading from the pilot output passage 48A or 48B to the pilot exhaust passage 49, causing the pressurized fluid fed to the piston chamber 45A or 45B to be ejected separately. As a result, the acting force of the pressure of the fluid flowing into the valve hole 20 from the supply through-hole P via the supply channel 21 works as returning force for the valve disc 25A or 25B to cause it to return.

First and second manual operating devices 54A and 54B provided in the pilot-valve main body 51 and piston box 16 are each constantly urged by a spring in the direction in which they protrude so that they can be pressed. When an accident such as that causing a service interruption prevents the solenoids 50A and 50B from driving the valve discs 25A and 25B, these devices are pressed to allow the pilot supply passage ps to communicate with the pilot output passages 48A and 45B to enable the valve discs 25A and 25B to be driven.

Figure 4:
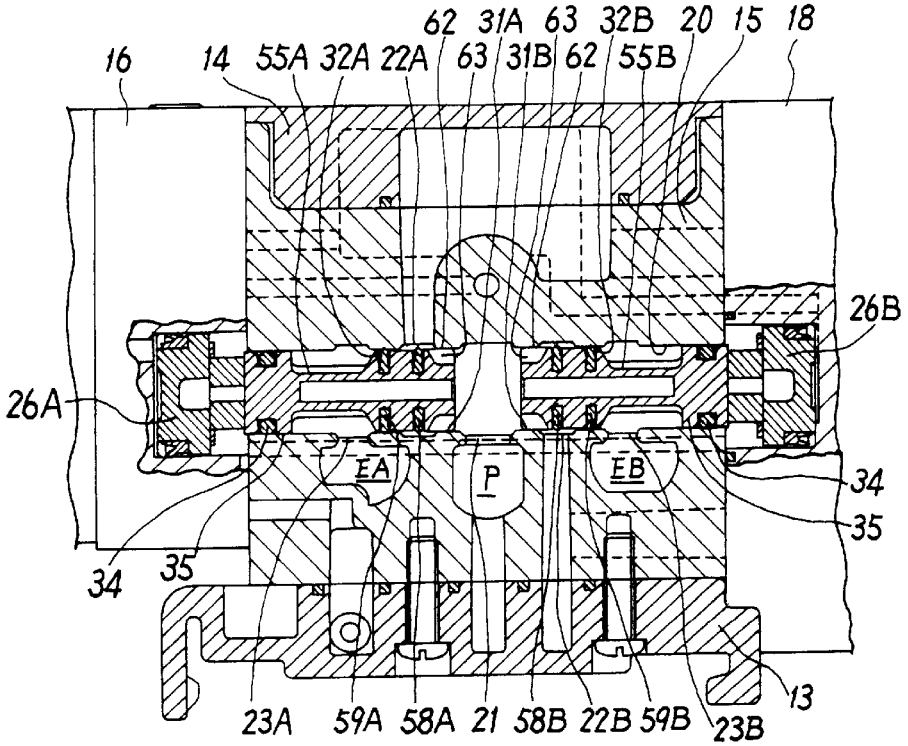
FIG. 4 is a schematic sectional view showing the structure of a second embodiment of a three-port solenoid valve according to this invention.

Although the first embodiment shown in FIG. 1 accommodates in the valve body 15 the valve discs 25A and 25B constituting two normally closed three-port valves, the structures of the valve discs may be changed slightly to provide two normally opened three-port valves, as in the second embodiment shown in FIG. 4.

As in the first embodiment, two valve discs 55A and 55B slidably disposed inside the valve hole 20 according to the second embodiment use the acting force of the fluid pressure in the supply channel 21 as the returning force for the valve discs 55A and 55B on the respective sides of the supply channel 21. The valve discs 55A and 55B, have seal members 58A and 58B, respectively, that seal the passages between the supply channel 21 and the output channels 22A and 22B, respectively; and seal members 59A and 59B that open and close the passages between the output channels 22A and 22B and the ejection channels 23A and 23B.

In response to the operation of the valve discs, the seal members 28A and 28B according to the first embodiment repeatedly move between the intermediate position at which they are located on the supply channel 21 and the sealing position between the supply channel 21 and the output channels 22A and 22B at which they move onto the lands 31A and 31B, respectively, while in response to the operation of the valve discs the seal members 29A and 29B repeatedly move between the intermediate position at which they are located on the ejection channels 23A and 23B, respectively, and the sealing position between the ejection channels 23A and 23B and the output channels 22A and 22B at which they move onto the lands 32A and 32B, respectively. However, according to the second embodiment, in response to the operation of the valve discs, the seal members 58A and 58B move between the intermediate position at which they are located on the output channel 22A or 22B and the sealing position between the supply channel 21 and the output channels 22A and 22B at which they move onto the lands 31A and 31B, respectively, while the seal members 59A and 59B move between the intermediate position at which they are located on the output channels 22A or 22B, respectively, and the sealing position between the ejection channels 23A and 23B and the output channels 22A and 22B at which they move onto the lands 32A and 32B, respectively, thereby allowing the two valve discs 55A and 55B to constitute normally opened three-port valves.

Of course, when one of the seal sections is in the intermediate position, the other seal section is in the sealing position, whereas when one of the seal sections is in the sealing position, the other seal section is in the intermediate position.

In addition, to stabilize the positions of the valve discs 55A and 55B and allow the seal members 58A and 58B to smoothly move onto the lands, a guide section 35 similar to the guide section in the first embodiment is provided on the piston side of the valve discs 55A and 55B, and a plurality of axial guide sections 62 that are located on the lands 31A and 31B to guide the seal members 58A and 58B onto the lands even when the seal members are dislocated from the lands provided around the valve discs on the supply-channel 21 side of the seal members 58A and 58B so that a channel groove 63 for a fluid flowing through the supply-channel 21 is provided between the guide sections 62.

As shown as FIG. 3, valve discs 25A and 25B each include two constricted parts 25*a*, 25*a* located between sealing members 28, 29; 29, 34, the constricted parts 25*a*, 25*a* serving as channels, and includes a plurality of ribs 36*a*, 36*a* which extend along the axial direction in the constricted parts 25*a*, 25*a*. Each of the ribs 36*a*, 36*a* has guide sections 35, 36 located at the end portion thereof and the channel grooves 37 are provided between the ribs, the channel grooves 37 stabilizing fluid flow which flows along the valve disc between ports to smooth movement of the valve discs 25A, 25B, so as to lengthen the life span sealing members without overstraining the same.

The configuration and operation of the second embodiment in FIG. 4 is substantially the same as those of the first embodiment of FIG. 1–3, so identical or equivalent main components have the same reference numerals and their description is omitted.

Figure 5:
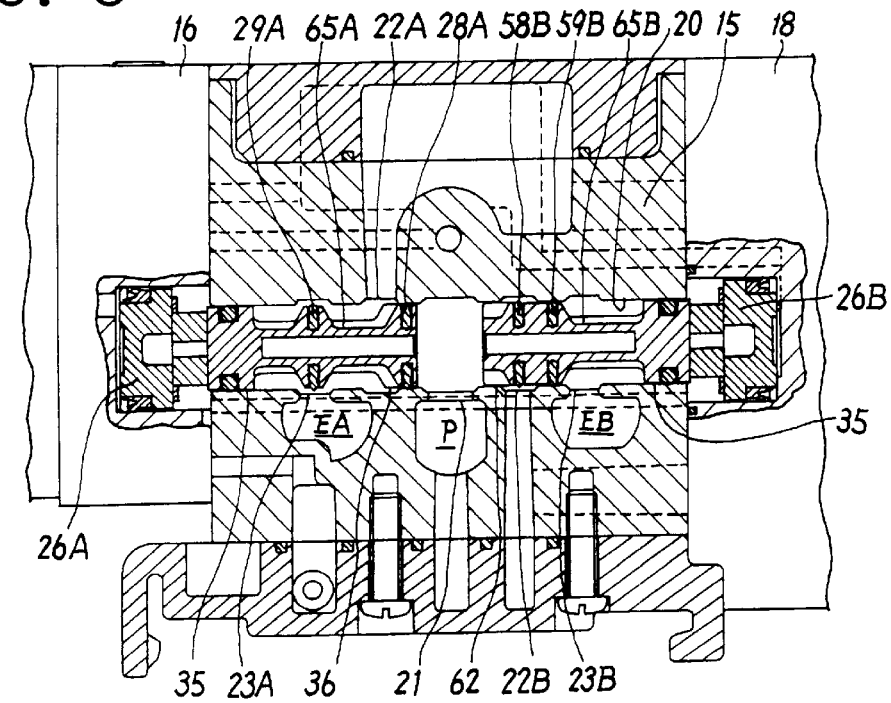
FIG. 5 is a schematic sectional view showing the structure of a third embodiment of a three-port solenoid valve according to this invention.

FIG. 5 shows a third embodiment of this invention. This solenoid valve uses a five-port valve body 15 that is almost the same as in the first embodiment, and one of the valve discs 65A inserted into the valve hole 20 is configured as a normally closed valve as in the first embodiment, but the other valve disc 65B is configured as a normally opened valve as in the second embodiment. Also as in the above embodiments, the acting force of the fluid pressure in the supply channel is used as returning force for the valve discs 65A and 65B on the respective sides of the supply channel 21. Also as in the above embodiments, the guide section 35 and the axial guide section 36 and 62 are provided near the respective ends of each of the valve discs 65A and 65B to stabilize the positions of the valve discs.

The other configuration and operation of the third embodiment are substantially the same as those of the first embodiment for the valve disc 65A and those of the second embodiment for the valve disc 65B, so identical or equivalent main components have the same reference numerals and their description is omitted.

According to the three-port solenoid valve of this invention described above in detail, inexpensive three-port valves can be obtained, wherein if a large number of five-port valves are connected together, the three-port valves can be used in combination with such five-port valves by integrating two three-port solenoid valves into a valve body for a five-port solenoid valve. Furthermore, in a solenoid valve using a valve body for a five-port solenoid valve, the axial movement of the valve discs can be stably guided. In addition, the solenoid valve can be configured as a normally closed or normally opened valve by slightly changing the structure of the valve disc.

What is claimed is:

1. A three-port solenoid valve using a valve body for a five-port solenoid valve, comprising a main valve having a five-port valve body in which a valve hole is opened and which has a supply channel opened at the center of the valve hole, two output channels opened on the respective sides of the supply channel, and two ejection channels opened on the respective sides of the output channels, with the main valve also having a valve disc slidably disposed in said valve hole, and first and second pistons on the respective axial sides of said valve hole, with the main valve operating the valve disc using the effect of a pilot fluid pressure on the pistons, the solenoid valve also comprising a pilot-valve section having first and second pilot valves including first and second solenoid mechanisms that operate to individually apply a pilot-fluid pressure to said first and second pistons, wherein:

the valve disc inserted into the valve hole in said valve body comprises two valve discs using a fluid pressure source in the supply channel as a returning force for the valve discs on the respective sides of the supply channel, wherein said valves each have a seal section for switching an output channel between the supply channel and the ejection channels, wherein:

a guide section for guiding the axial movement of the valve disc is provided at an end of each valve disc that is abutted by one of said pistons, and wherein a plurality of axial guide sections located on lands disposed on the respective sides of the supply channel, including when the seal section is in the communication section, are provided around the valve discs so that a channel groove for a fluid flowing through the channel is provided between the guide sections, the seal section switching movement of the fluid between the sealing positions located at both ends of the supply channel at which the seal section moves onto the lands, and a communication position at which the seal section is moveable away from the lands for the supply-channel side;

said valve disc having two constricted parts located between the sealing sections said constricted parts serving as channels for fluid flow, and including a plurality of ribs which extend along an axial direction of the constricted parts wherein each of the ribs includes a guide section located at an end thereof, and a plurality of channel grooves provided between the ribs, the channel grooves stabilizing fluid flow which flows along the valve disc between the ports so as to assist movement of the valve disc.

2. A solenoid valve according to claim 1 which comprises a plurality of axial guide sections located on lands disposed on the respective sides of the supply channel, including when the seal section is in the communication section, said axial guide sections being provided on a side that is moveable onto the lands such that a channel groove for a fluid flowing through the supply channel is provided between the guide sections, the seal section switching the movement of fluid between the sealing positions located at both ends of the supply channel at which the seal section moves onto the lands and a communication position at which the seal section is spaced from the lands for the supply-channel side.

3. A solenoid valve according to claim 1 which comprises a plurality of axial guide sections located on lands disposed on the respective sides of the supply channel, including when the seal section is in the communication section, said guide sections being provided on a side that is moveable onto the lands such that one of said channel grooves is positioned between the guide sections, the seal section switching movement of the fluid between the sealing positions located at the both ends of the supply channel at which the seal section moves onto the lands and a communication position at which the seal section is moveable away from the lands for the supply-channel side.

* * * * *